US008264151B2

(12) United States Patent
Jeong et al.

(10) Patent No.: US 8,264,151 B2
(45) Date of Patent: Sep. 11, 2012

(54) COLOR VARIABLE FIELD EMISSION DEVICE

(75) Inventors: Jin Woo Jeong, Daejeon (KR); Yoon Ho Song, Daejeon (KR); Dong Il Kim, Daejeon (KR); Jun Tae Kang, Daegu (KR); Ji Seon Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 390 days.

(21) Appl. No.: 12/550,814

(22) Filed: Aug. 31, 2009

(65) Prior Publication Data

US 2010/0156297 A1 Jun. 24, 2010

(30) Foreign Application Priority Data

Dec. 18, 2008 (KR) ..... 10-2008-0129664

(51) Int. Cl.
*H01J 25/50* (2006.01)

(52) U.S. Cl. ..... 315/72; 315/291

(58) Field of Classification Search ..... 315/160–169.3, 315/291, 209 R, 72
See application file for complete search history.

(56) References Cited

U.S. PATENT DOCUMENTS

| | | | | |
|---|---|---|---|---|
| 6,066,922 | A * | 5/2000 | Iwasaki et al. | 315/169.3 |
| 6,288,695 | B1 | 9/2001 | Wood | |
| 6,873,118 | B2 * | 3/2005 | Russ et al. | 315/169.3 |
| 8,018,169 | B2 | 9/2011 | Jeong et al. | |
| 2002/0047559 | A1 * | 4/2002 | Frayssinet et al. | 315/169.3 |
| 2007/0057283 | A1 | 3/2007 | Shiozaki et al. | |
| 2007/0103085 | A1 * | 5/2007 | Itoh et al. | 315/3 |

FOREIGN PATENT DOCUMENTS

| | | |
|---|---|---|
| EP | 1 443 538 | 8/2004 |
| JP | 2006-338935 | 12/2006 |
| KR | 10-2007-0098490 A | 10/2007 |
| KR | 10-2008-0017241 | 2/2008 |
| KR | 20-2008-0000678 | 4/2008 |

OTHER PUBLICATIONS

Jin-Woo Jeong, "15-in. Dynamic Field Emission BLU for LCD", IDW '08, The 15th International Display Workshops, 2008, pp. 2019-2020.
Soc Fair 2008 Exhibition & Conference (Oct. 14-17, 2008).

* cited by examiner

*Primary Examiner* — James H Cho
(74) *Attorney, Agent, or Firm* — Rabin & Berdo, P.C.

(57) ABSTRACT

A field emission device having a simple structure and capable of readily changing emission colors of light by adjusting emission intensity of red, green and blue light is provided. In the field emission device, current that flows into each cathode electrode block is adjusted according to a very low control pulse signal of 0 to 5 V with a predetermined voltage applied to an anode electrode and a gate electrode over time, so that emission intensities of red, green and blue are individually adjusted. Therefore, the current that flows into each cathode electrode block is adjusted in a simple manner using a control pulse signal of a low level without a separate pulse driving high-voltage power supply, so that emission intensities of red, green and blue can be arbitrarily adjusted and emission colors of the field emission device can be readily changed.

13 Claims, 5 Drawing Sheets

COLOR VARIABLE FIELD EMISSION DEVICE

CROSS-REFERENCE TO RELATED APPLICATION

This application claims priority to and the benefit of Korean Patent Application No. 10-2008-0129664, filed Dec. 18, 2008, the disclosure of which is incorporated herein by reference in its entirety.

BACKGROUND

1. Field of the Invention

The present invention relates to a color variable field emission device, and more particularly, to a field emission device having a simple structure and capable of adjusting emission intensity of red, green and blue light, respectively, to readily change emission colors.

2. Discussion of Related Art

Generally, in a triode-type field emission device, when a gate electrode induces electron emission from a field emitter formed on a cathode electrode, the emitted electrons collide with a fluorescent layer formed on an anode electrode, so that cathode luminescence of the fluorescent layer causes light to be generated.

However, the conventional triode-type field emission device necessarily applies a high-voltage pulse as high as several to several tens of volts to the gate electrode in order to adjust brightness. Accordingly, the device requires a separate pulse driving high-voltage power supply for applying such a high-voltage pulse, which results in a complicated drive circuit and increased manufacturing costs.

In addition, while the conventional triode-type field emission device is easily applied to a general field emission display (FED), its structure is somewhat complicated to be applied to a field emission lamp.

SUMMARY OF THE INVENTION

The present invention is directed to a field emission device having a simple structure and capable of readily changing emission colors of light by individually adjusting emission intensity of red, green and blue light.

One aspect of the present invention provides a color variable field emission device including: a cathode substrate and an anode substrate that are disposed to face each other with a predetermined distance therebetween; first, second and third cathode electrode blocks formed on the cathode substrate to be electrically separated from each other; first, second and third field emitter blocks formed on the first, second and third cathode electrode blocks, respectively, in predetermined patterns; an anode electrode formed on the anode substrate; red, green and blue fluorescent layers formed on the anode electrode to correspond to the first, second and third field emitter blocks, respectively, in predetermined patterns; a gate electrode disposed between the cathode substrate and the anode substrate to induce electron emission from each of the field emitter blocks; and a plurality of current switching circuits electrically connected to each of the cathode electrode blocks to individually control current that flows into each of the cathode electrode blocks.

When the current that is applied to each of the cathode electrode blocks is individually adjusted through the current switching circuits with a predetermined voltage applied to the anode electrode and the gate electrode over time, the amount of electrons emitted from the first, second and third field emitters formed on the cathode electrode blocks, respectively, may be adjusted, so that emission intensity of light emitted from the red, green and blue fluorescent layers may be individually adjusted.

The current switching circuit may include a current switching device electrically connected to each cathode electrode block to adjust current that flows into the corresponding cathode electrode block, and a pulse generator providing the current switching device with a control pulse signal that repeats a high level and a low level within a range of 0 to 5 V.

When the control pulse signal that repeats a high level and a low level is applied to the current switching device with a predetermined voltage applied to the anode electrode and the gate electrode over time, the current switching device may be turned on only during the high level of the control pulse signal, so that current flows into the cathode electrode block connected to the current switching device. Also, the current switching device may be turned off during the low level of the control pulse signal, so that current may be prevented from flowing into the cathode electrode block connected to the current switching device.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF EMBODIMENTS

The present invention will be described more fully hereinafter with reference to the accompanying drawings, in which exemplary embodiments of the invention are shown. This invention may, however, be embodied in different forms and should not be construed as limited to the embodiments set forth herein.

A color variable field emission device according to the present invention will be described in detail with reference to the accompanying drawings.

Figure 1:
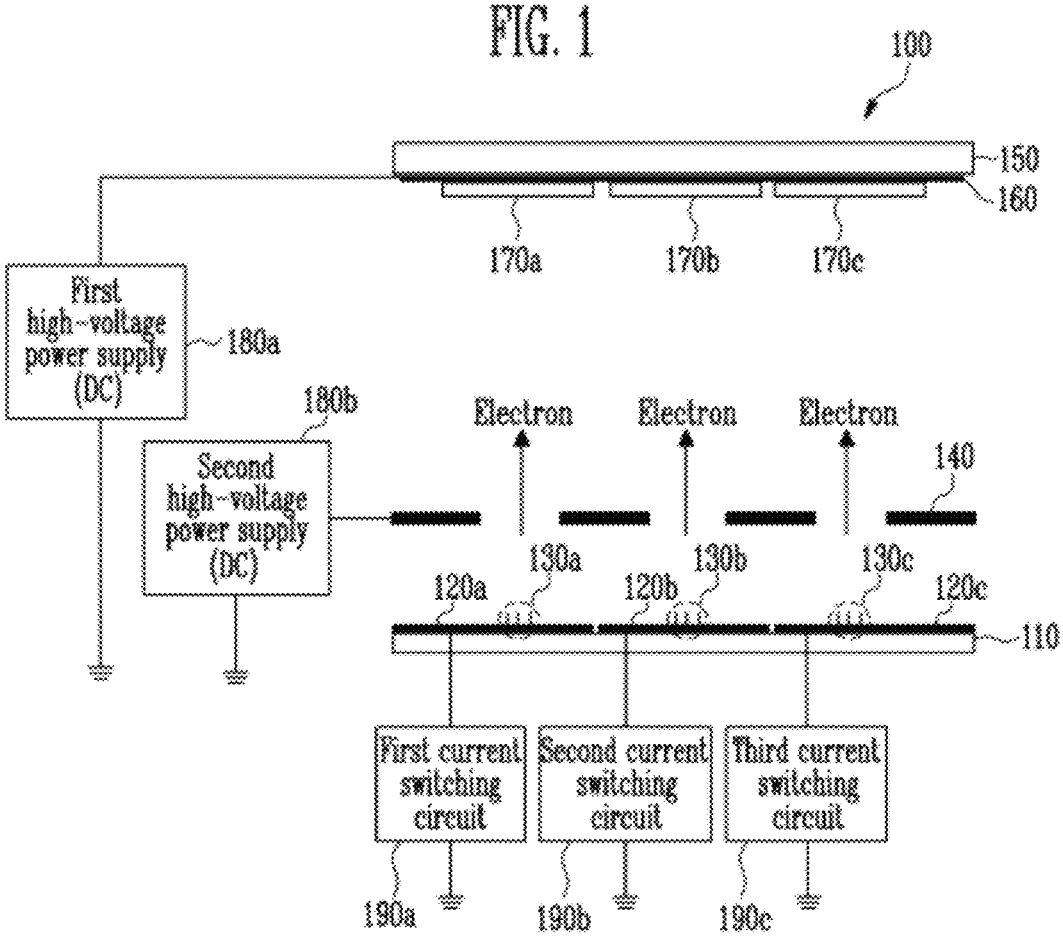
FIG. 1 illustrates a color variable field emission device according to the present invention.

FIG. 1 illustrates a color variable field emission device 100 according to the present invention.

Referring to FIG. 1, the color variable field emission device 100 according to the present invention includes a cathode substrate 110, first to third cathode electrode blocks 120*a*, 120*b* and 120*c* that are formed on the cathode substrate 110 to be electrically separated from each other, field emitter blocks 130*a*, 130*b* and 130*c* that are formed on the first to third cathode electrode blocks 120*a*, 120*b* and 120*c*, respectively, a gate electrode 140 inducing electron emission from the field emitter blocks 130*a*, 130*b* and 130*c*, an anode substrate 150 disposed to face the cathode substrate with a predetermined distance therebetween, an anode electrode 160 formed on the anode substrate 150, red, green and blue fluorescent layers 170*a*, 170*b* and 170*c* formed on the anode electrode 160, first and second high-voltage power supplies 180*a* and 180*b* respectively and constantly applying a DC voltage to the anode electrode 160 and the gate electrode 140 over time, and a plurality of current switching circuits 190*a*, 190*b* and 190*c* that are connected to the cathode electrode blocks 120*a*, 120*b* and 120*c*, respectively, to control current flowing into the corresponding cathode electrode blocks 120*a*, 120*b* and 120*c*.

Here, the sequence of the red fluorescent layer 170*a*, the green fluorescent layer 170*b*, and the blue fluorescent layer 170*c* may be changed, and field emitter blocks that are formed to correspond to the red, green and blue fluorescent layers 170*a* to 170*c*, respectively, are referred to as first to third field emitter blocks 130*a* to 130*c* for the sake of simplicity.

When electrons are emitted from the first to third field emitter blocks 130*a*, 130*b* and 130*c* due to a DC voltage applied to the gate electrode 140, the emitted electrons are accelerated by the DC voltage applied to the anode electrode 160 to collide with the red, green and blue fluorescent layers 170*a* to 170*c*, so that red, green and blue light emission occurs.

At this time, when an amount of current that flows from each of the cathode electrode blocks 120*a*, 120*b* and 120*c* is adjusted using the current switching circuits 190*a*, 190*b* and 190*c* serially connected to the cathode electrode blocks 120*a*, 120*b* and 120*c*, respectively, the amount of electrons emitted from the first to third field emitter blocks 130*a*, 130*b* and 130*c* is adjusted, respectively, and as a result, emission intensity of red, green and blue light emitted from the red, green and blue fluorescent layers 170*a* to 170*c* is adjusted as well.

Constitutions and operations of the current switching circuits 190*a*, 190*b* and 190*c* will be described below in detail.

Figure 2:
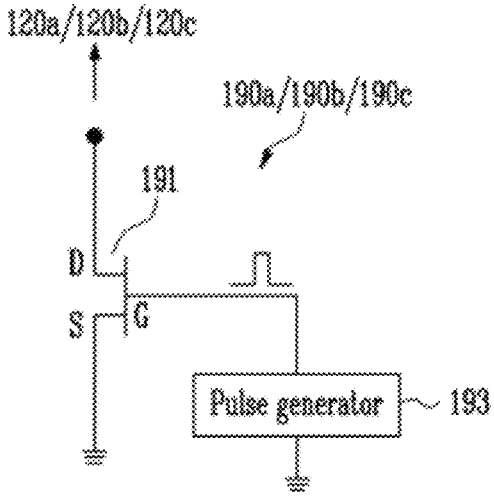
FIG. 2 is a diagram illustrating constitutions and operations of current switching circuits in the color variable field emission device according to the present invention.

FIG. 2 is a diagram illustrating constitutions and operations of the current switching circuits 190*a*, 190*b* and 190*c* in the color variable field emission device 100 according to the present invention.

Referring to FIG. 2, each of the current switching circuits 190*a*, 190*b* and 190*c* is serially connected between each of the cathode electrode blocks 120*a* to 120*c* and a ground, and includes a current switching device 191 adjusting current that flows from the corresponding cathode electrode blocks 120*a* to 120*c* and a pulse generator 193 providing the current switching device 191 with a control pulse signal that repeats a high level and a low level.

Here, the control pulse signal has a voltage value of a high or low level within a range of 0 to 5 V.

A high-voltage transistor may be used for the current switching device 191, and in such a case, the control pulse signal is input into a gate terminal of the high-voltage transistor, a drain terminal is connected to each of the cathode electrode blocks 120*a* to 120*c*, and a source terminal is connected to the ground.

Here, in order to prevent overvoltage from being applied to the current switching device 191, a resistor or a reactance device may be connected to the drain terminal of the current switching device 191 in series. Further, in order to prevent overcurrent from being applied to the current switching device 191, zener diodes or varistors may be connected in parallel between the drain and source terminals of the current switching device 191.

When the control pulse signal repeating a high level and a low level is applied to the current switching device 191 from the pulse generator 193, the corresponding current switching device 191 is turned on only during the high level of the control pulse signal. As a result, current flows into the cathode electrode blocks 120*a* to 120*c* connected to the corresponding current switching device 191, and thus electrons are emitted from only the field emitter blocks 130*a* to 130*c* on the corresponding cathode electrode blocks 120*a* to 120*c*.

During the low level of the control pulse signal, the corresponding current switching device 191 is turned off to prevent current from flowing into the cathode electrode blocks 120*a* to 120*c* connected to the corresponding current switching device 191. Accordingly, electron emission from the field emitter blocks 130*a* to 130*c* on the corresponding electrode blocks 120*a* to 120*c* ceases.

Here, the amount of electrons emitted from each of the field emitter blocks 130*a* to 130*c* may be adjusted by means of pulse width modulation (PWM) or pulse amplitude modulation (PAM).

In PWM, an on/off duty cycle is adjusted with a fixed voltage level of the control pulse signal, and in PAM, a voltage level is varied with a fixed on/off duty cycle of the control pulse signal.

That is, the field emission device 100 according to the present invention enables each of the field emitter blocks 130*a* to 130*c* to emit a different amount of electrons to be emitted through each of the current switching circuits 190*a* to 190*c*. As a result, emission intensities of red, green and blue emitted from the red, green and blue fluorescent layers 170*a* to 170*c* can be individually adjusted.

Meanwhile, in order to exhibit uniform brightness over a large area, the red, green and blue fluorescent layers 170*a* to 170*c* should emit light with constant emission intensity, a description of which will be provided below.

Figure 3:
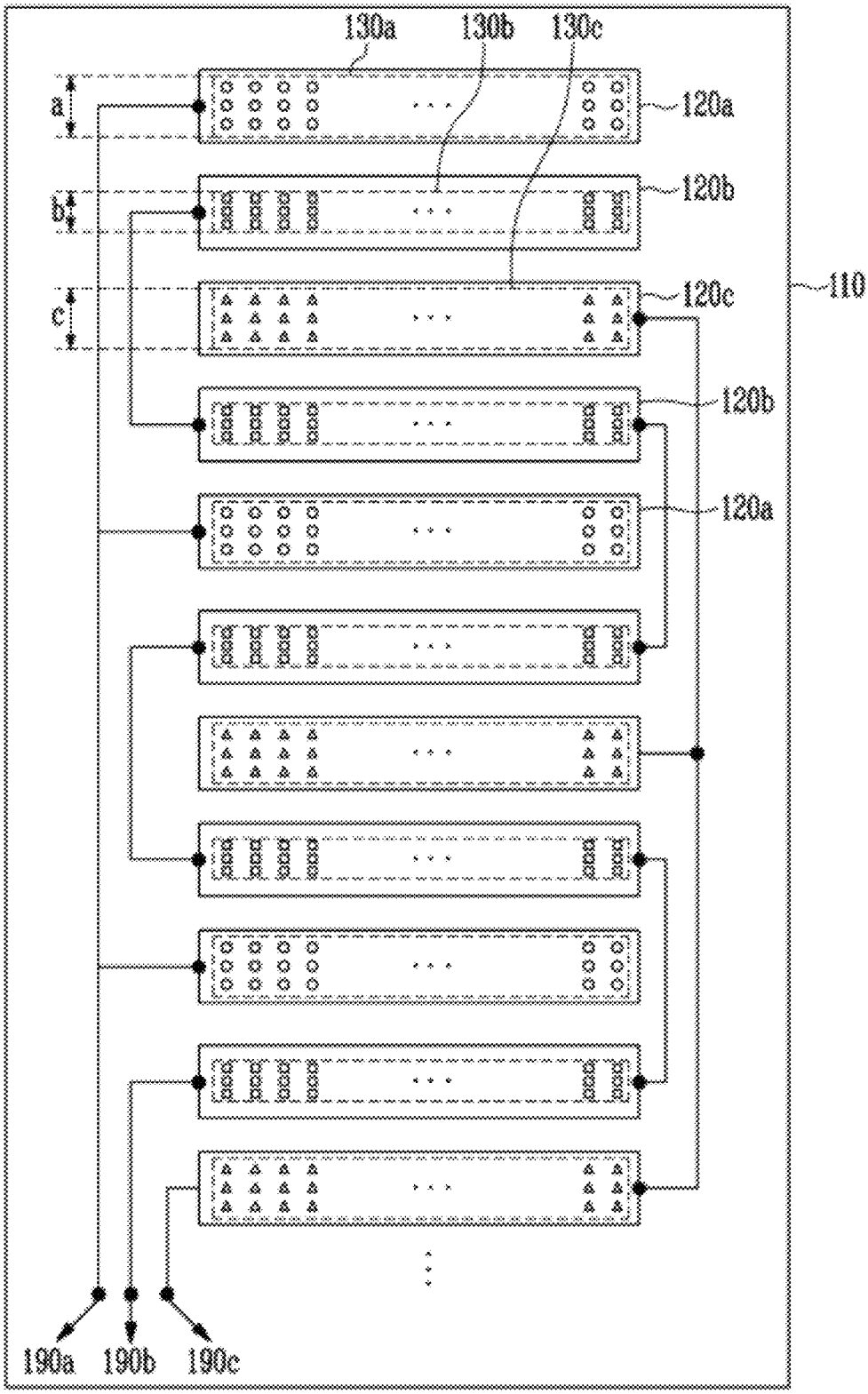
FIGS. 3 and 4 respectively illustrate a structure in which field emitter blocks are disposed, and red, green and blue fluorescent layers are disposed in a field emission device according to the present invention.
Figure 4:
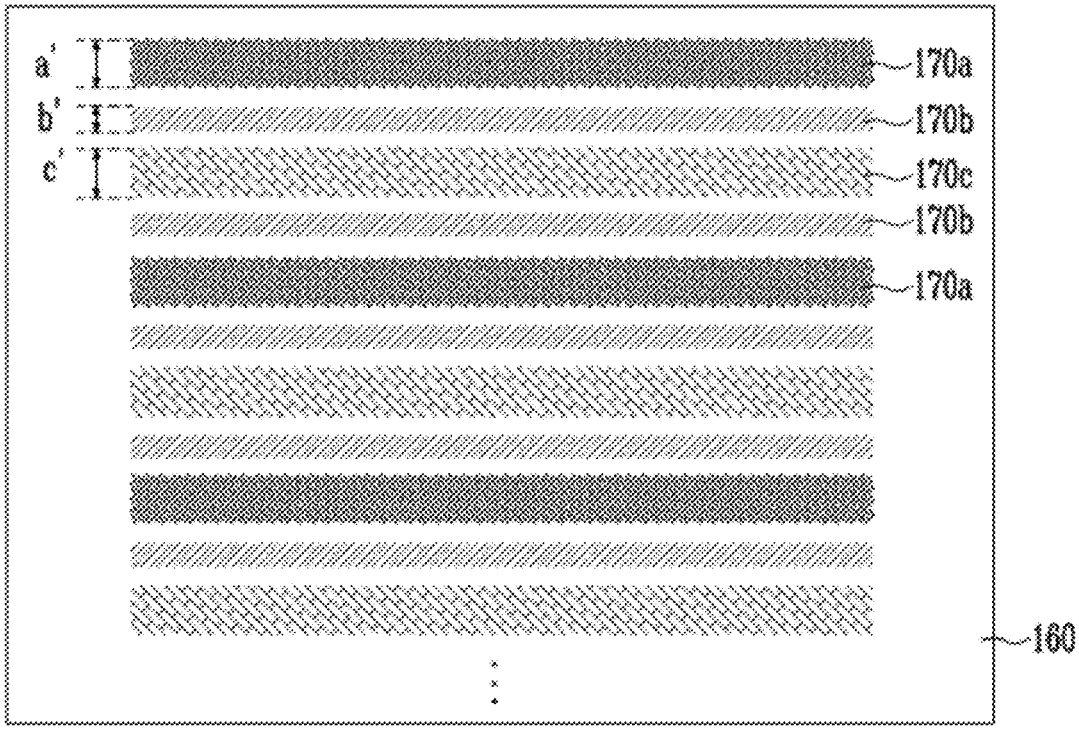

FIGS. 3 and 4 respectively illustrate a structure in which field emitter blocks 130*a* to 130*c* are disposed, and red, green and blue fluorescent layers 170*a* to 170*c* are disposed in the field emission device 100 according to the present invention.

Referring to FIG. 3, the first to third field emitter blocks 130*a* to 130*c* are repeatedly formed on the cathode electrode blocks 120*a* to 120*c* that are electrically separated from each other to be adjacent to each other, and field emitter blocks corresponding to the same fluorescent layer are electrically connected to each other.

Describing the structure in which the first to third field emitter blocks 130*a* to 130*c* are disposed in further detail, the first field emitter block 130*a* and the third field emitter block 130*c* are alternately disposed, and the second field emitter block 130*b* is filled in between the first field emitter block 130*a* and the third field emitter block 130*c*.

Therefore, in order for the red, green and blue fluorescent layers 170*a* to 170*c* to have the same emission intensity, a width b of the second field emitter block 130*b* may be formed to be one half of widths a and c of the first and third field emitter blocks 130*a* and 130*c*.

Referring to FIG. 4, the red, green and blue fluorescent layers 170*a* to 170*c* are disposed in a similar manner to the first to third field emitter blocks 130*a* to 130*c*.

That is, the red fluorescent layer 170*a* and the blue fluorescent layer 170*c* are alternately disposed, and the green fluorescent layer 170*b* is filled in between the red fluorescent layer 170*a* and the blue fluorescent layer 170*c*.

Therefore, in order for the red, green and blue fluorescent layers 170*a* to 170*c* to have the same emission intensity, a width b' of the green fluorescent layer 170*b* may be formed to be one half of widths a' and c' of the red and blue fluorescent layers 170*a* and 170*c*.

Figure 5:
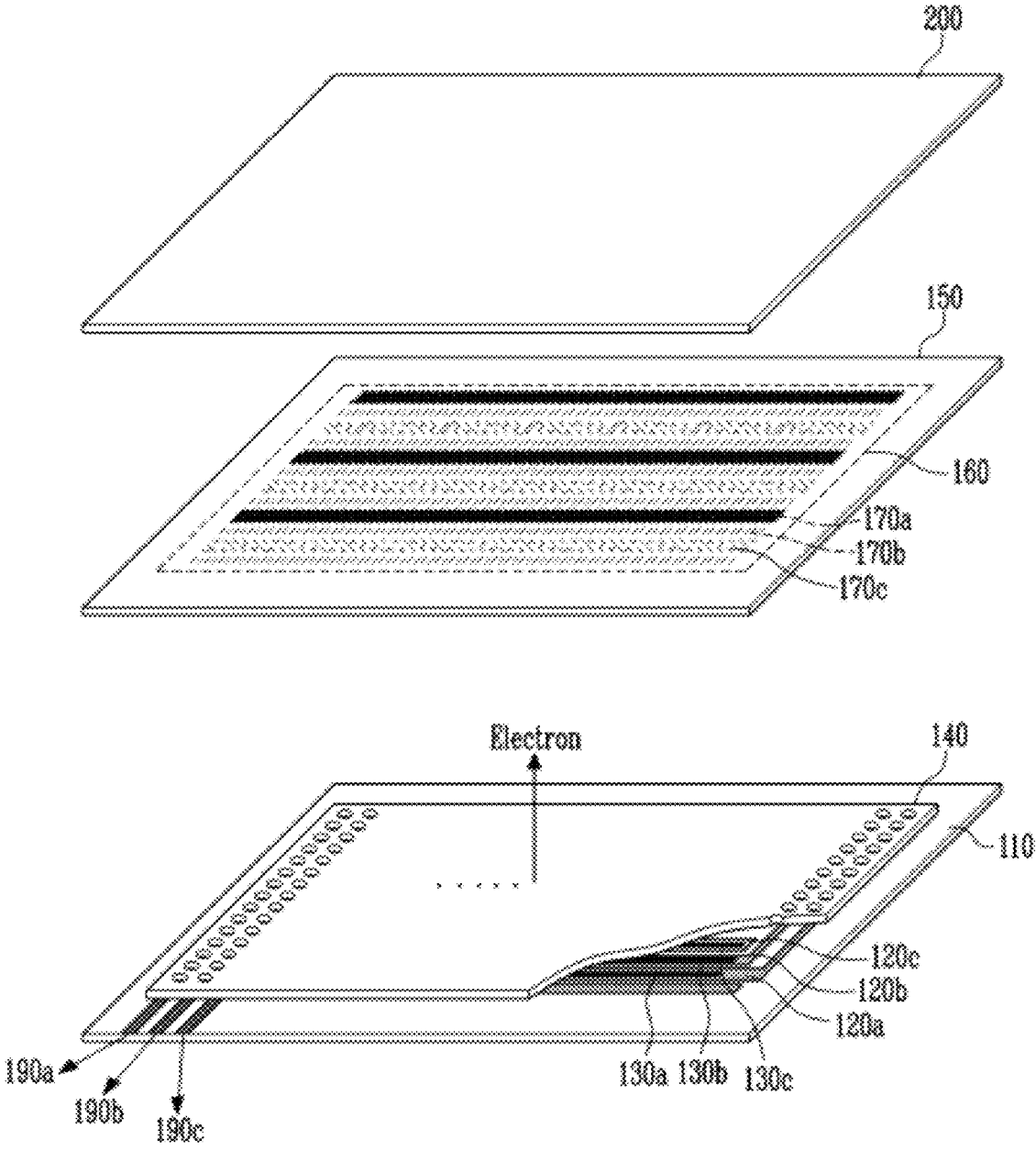
FIG. 5 illustrates field emission operations of a color variable field emission device according to the present invention.

FIG. 5 illustrates field emission operations of the color variable field emission device 100 according to the present invention.

As illustrated in FIG. 5, when electrons are emitted from each of the field emitter blocks 130*a* to 130*c* formed on the cathode electrode blocks 120*a* to 120*c* due to a DC voltage applied to the gate electrode 140, the emitted electrons are accelerated by the DC voltage applied to the anode electrode 160, and collide with the red, green and blue fluorescent layers 170*a* to 170*c* to emit red, green and blue light.

At this time, when the amount of current that flows from each of the cathode electrode blocks 120*a* to 120*c* is adjusted using the current switching circuits 190*a* to 190*c*, the amount of electrons emitted from the field emitter blocks 130*a* to 130*c* may be adjusted. As a result, emission intensity of light emitted from the red, green and blue fluorescent layers 170*a* to 170*c* is adjusted, so that emission colors of the field emission device can be arbitrarily adjusted.

Meanwhile, in order to effectively mix the three colors of red, green and blue emitted from the red, green and blue fluorescent layers 170*a* to 170*c*, a diffusion plate 200 may be additionally disposed over the anode substrate 150.

Figure 6A:
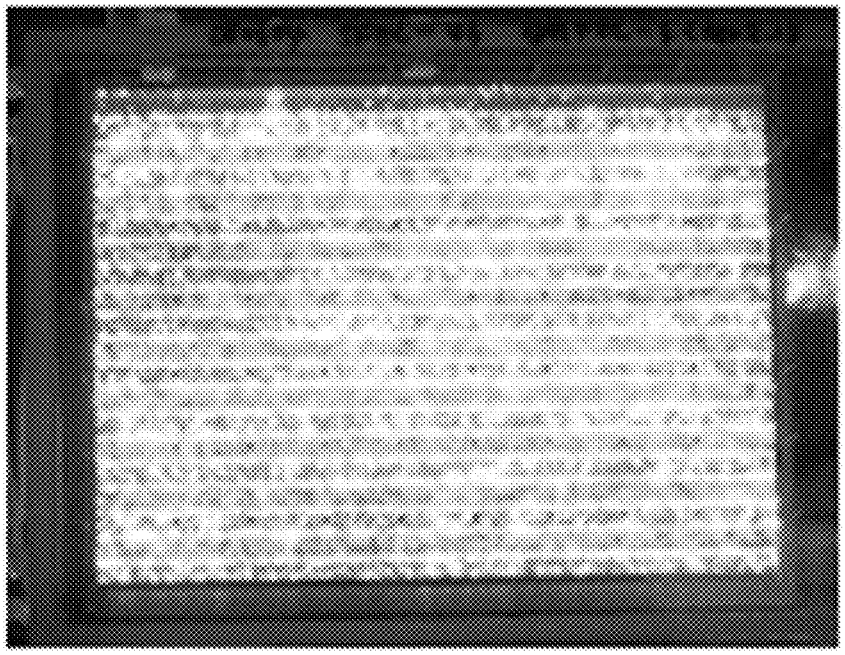
FIGS. 6A and 6B illustrate a state of a color variable field emission device according to the present invention actually emitting light.
Figure 6B:
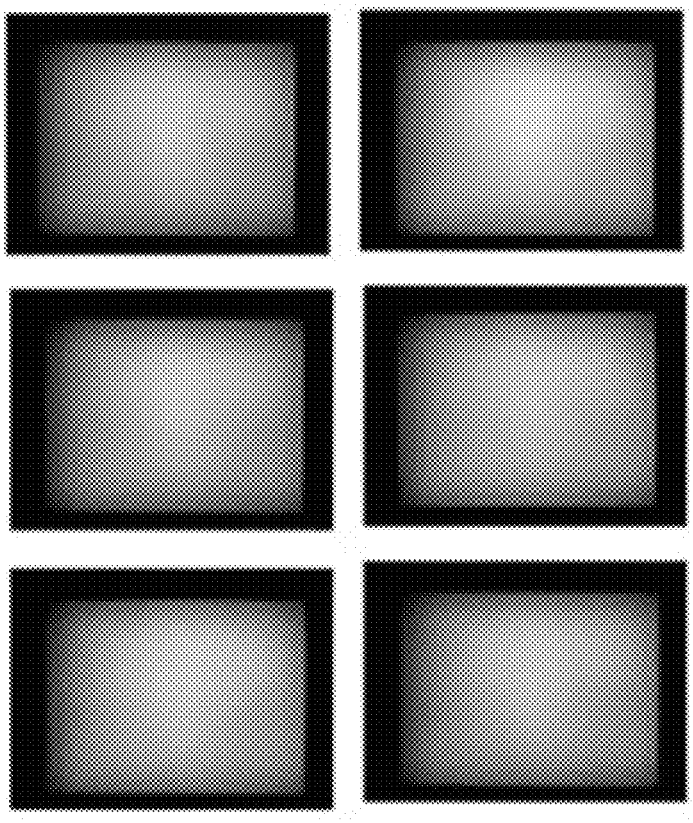

FIGS. 6A and 6B illustrate a color variable field emission device actually emitting light according to the present invention. In FIG. 6A, a state in which the color variable field emission device emits light without a diffusion plate is illustrated, and in FIG. 6B, various emission states in which the color variable field emission device emits light with a diffusion plate are illustrated.

As illustrated in FIG. 6A, when the red, green and blue light emitted from the red, green and blue fluorescent layers 170*a* to 170*c* of the color variable field emission device according to the present invention has the same emission intensity, this produces white as a whole. As illustrated in FIG. 6B, when the red, green and blue light emitted from the red, green and blue fluorescent layers 170*a* to 170*c* has different emission intensities, this produces various colors.

In conclusion, in the field emission device 100 according to the present invention, current that flows into each of the cathode electrode blocks 120*a* to 120*c* is adjusted according to a very low control pulse signal of 0 to 5 V with a predetermined voltage applied to the anode electrode 160 and the gate electrode 140 over time, so that emission intensities of red, green and blue can be individually adjusted. Accordingly, the present invention simplifies the structure and facilitates adjustment of emission colors without a pulse driving high-voltage power supply compared with a conventional field emission device.

According to the present invention, current that flows into each cathode electrode block is adjusted in a simple manner using a control pulse signal of a low voltage level without a pulse driving high-voltage power supply, and thus emission intensities of red, green and blue can be arbitrarily adjusted, so that emission colors of the field emission device can be readily changed.

In the drawings and specification, there have been disclosed typical exemplary embodiments of the invention and, although specific terms are employed, they are used in a generic and descriptive sense only and not for purposes of limitation. As for the scope of the invention, it is to be set forth in the following claims. Therefore, it will be understood by those of ordinary skill in the art that various changes in form and details may be made therein without departing from the spirit and scope of the present invention as defined by the following claims.

What is claimed is:

1. A color variable field emission device, comprising:

a cathode substrate and an anode substrate that are disposed to face each other with a predetermined distance therebetween;

first, second and third cathode electrode blocks formed on the cathode substrate to be electrically separated from each other;

first, second and third field emitter blocks formed on the first, second and third cathode electrode blocks, respectively, in predetermined patterns;

an anode electrode formed on the anode substrate;

red, green and blue fluorescent layers formed on the anode electrode to correspond to the first, second and third field emitter blocks, respectively, in predetermined patterns;

a gate electrode disposed between the cathode substrate and the anode substrate to induce electron emission from each of the field emitter blocks; and a plurality of current switching circuits electrically connected to each of the cathode electrode blocks to individually control current that flows into each of the cathode electrode blocks, wherein when the current that is applied to each of the cathode electrode blocks is individually adjusted through the current switching circuits with a predetermined anode voltage applied to the anode electrode and a predetermined gate voltage applied to the gate electrode over time, the amount of electrons emitted from the first, second and third field emitter blocks formed on the cathode electrode blocks, respectively, is adjusted, so that emission intensity of light emitted from the red, green and blue fluorescent layers is individually adjusted.

2. The device of claim 1, wherein each current switching circuit comprises:

a current switching device electrically connected to a respective one of the cathode electrode blocks to adjust current that flows through the respective one of the cathode electrode blocks; and a pulse generator providing the current switching device with a control pulse signal that repeats a high level and a low level.

3. The device of claim 2, wherein the current switching device is a high-voltage transistor, wherein the high-voltage transistor has a gate terminal to which the control pulse signal is input, a drain terminal connected to the respective one of the cathode electrode blocks, and a source terminal connected to a ground.

4. The device of claim 2, wherein the control pulse signal has a voltage value of a high or low level within a range of 0 to 5 V.

5. The device of claim 2, wherein when the control pulse signal that repeats a high level and a low level is applied to the current switching device with the predetermined anode voltage applied to the anode electrode and the predetermined gate voltage applied to the gate electrode over time, the current switching device is turned on only during the high level of the control pulse signal, so that current flows into the cathode electrode block connected to the current switching device.

6. The device of claim 5, wherein the current switching device is turned off during the low level of the control pulse signal, so that current is prevented from flowing into the cathode electrode block connected to the current switching device.

7. The device of claim 5, wherein the amount of current that flows into the cathode electrode block is adjusted by pulse width modulation (PWM) in which an on/off duty cycle of the control pulse signal is adjusted with a fixed voltage level of the control pulse signal.

8. The device of claim 5, wherein the amount of current that flows into the cathode electrode block is adjusted by pulse amplitude modulation (PAM) in which a voltage level of the control pulse signal is varied with a fixed on/off duty cycle of the control pulse signal.

9. The device of claim 1, wherein the first field emitter block and the third field emitter block are alternately disposed, and the second field emitter block is filled in between the first field emitter block and the third field emitter block.

10. The device of claim 9, wherein the width of the second field emitter block is one half of the widths of the first and third field emitter blocks.

11. The device of claim 9, wherein the red fluorescent layer and the blue fluorescent layer are alternately disposed, and the green fluorescent layer is filled in between the red fluorescent layer and the blue fluorescent layer.

12. The device of claim 11, wherein the width of the green fluorescent layer is one half of the widths of the red and blue fluorescent layers.

13. The device of claim 1, further comprising a diffusion plate formed on the anode substrate to mix red, green and blue light emitted from the red, green and blue fluorescent layers.

* * * * *